United States Patent [19]

Kawamura et al.

[11] Patent Number: 4,694,268

[45] Date of Patent: Sep. 15, 1987

[54] SUPERCONDUCTING SOLENOID HAVING ALUMINA FIBER INSULATOR

[75] Inventors: Toshimi Kawamura, Kobe; Tadatoshi Yamada, Amagasaki; Kiyoshi Hani, Amagasaki; Kiyoshi Yoshizaki, Amagasaki, all of Japan

[73] Assignee: Mitsubishi Denki Kabushiki Kaisha, Japan

[21] Appl. No.: 868,554

[22] Filed: May 30, 1986

[30] Foreign Application Priority Data

May 31, 1985 [JP] Japan ..... 60-119123

[51] Int. Cl.[4] ..... H01F 7/22

[52] U.S. Cl. ..... 335/216; 174/126 S

[58] Field of Search ..... 174/126 S, 128 S; 335/216, 299; 336/DIG. 1

[56] References Cited

U.S. PATENT DOCUMENTS 3,428,925 2/1969 Bogner et al. ..... 335/216
3,432,783 3/1969 Britton et al. ..... 335/216
3,440,336 4/1969 Bogner ..... 335/216 X
3,440,585 4/1969 Freeman ..... 335/216

OTHER PUBLICATIONS

"An Additional Technique of 'Wind and React' Method", Oishi et al., May, 1982, The Furukawa Electric Co., Hiratsuka, Japan.

*Primary Examiner*—George Harris
*Attorney, Agent, or Firm*—Leydig, Voit & Mayer

[57] ABSTRACT

A superconducting solenoid designed to improve working efficiency, heat resistance and electrical insulation of the solenoid to a practical extent. The superconducting solenoid comprises a winding frame, wires formed of filamentary conductors having superconductivity and wound around the winding frame, an insulator formed of alumina fiber material and covering each of the wires for providing electrical insulation, and a resinous material impregnated in between turns of the wires so as to provide a supporting structure. The insulator formed of alumina fiber material is in the form of a sheet, a mat or a yarn.

6 Claims, 5 Drawing Figures

SUPERCONDUCTING SOLENOID HAVING ALUMINA FIBER INSULATOR

BACKGROUND OF THE INVENTION

1. Field of the Invention

The present invention relates to a superconducting solenoid, and more particularly, to an insulating structure for such a superconducting solenoid which is capable of improving superconducting stability and electrical insulation.

2. Description of the Prior Art

FIG. 3 is a cross sectional view of a superconducting solenoid, generally designated by reference numeral 100, made in accordance with a conventional "wind and react" procedure, which is described in literature such as, for example, in a paper entitled "High-Field Magnet Formed of New $Nb_3Sn$ Wires", by Koizumi et al., issued in May 1978 in the preprint of the Twentieth Meeting of the Cryogenic Association of Japan.

In this Figure, the superconducting solenoid 100 includes a winding frame or core 101 in the form of a cylinder and a coil winding 102 which, as clearly illustrated in FIG. 4, is made by winding wires 103 of filamentary conductors around the winding frame 101, each of the wires being covered with an electrical insulator 104 formed of a heat-resisting material such as glass fibers. The wires 103 thus wound around the winding frame 101 are heat treated to provide superconductivity, and a resinous material 105 is impregnated between turns in the winding so as to obtain a sturdy winding construction.

Now, a conventional coil-making procedure will be described. First, wires of filamentary conductors formed of unreacted metal composite are prepared which are each covered with an insulator formed of an electrically insulating material. For such an electrically insulating material, glass fibers having heat resistance and formed into a yarn are chosen. In this connection, however, it is to be noted that since there are various kinds of glass fibers ranging from low grades to high grades, glass fibers, generally called E glass, S glass or the like, are employed which have a melting point higher than about 850° C. To improve workability and stability of the glass fibers, binders such as starch are added in the smallest possible quantities. The wires thus covered with the insulator of glass fibers are wound around a winding frame or core and then heat treated or fired at a temperature of about 800° C. to produce $Nb_3Sn$, thus making a superconducting solenoid.

The superconducting solenoid in this state, however, has a loose winding structure and can not operate in an appropriate manner. This is because clearances formed between the coil windings permit the wires of filamentary conductors to move relative to each other under the action of magnetic field created upon energization of the solenoid so that superconductivity of the solenoid will collapse due to frictional heat generated by mechanical contact of neighboring turns of wires and/or generation of heat caused by electromagnetic forces. In order to prevent such a situation, it is ordinary practice to impregnate a resinous material between turns in the winding, as illustrated in FIG. 4, thereby ensuring superconducting stability.

With the conventional superconducting solenoid as constructed in the above-described "wind and react" procedure, the component of starch contained in the glass fibers decomposes during heat treatment with the result that carbon thus decomposed remains sedimented in and adhered to the coil windings, considerably reducing the insulating resistance and hence creating reliability problems in the operation of the entire solenoid. Otherwise, even though it is possible for the solenoid to operate properly in practice, it becomes difficult to detect defects, such as short-circuits of the coil windings which may occur during the production process of the solenoid, by measuring voltage drops or the inductance of the solenoid since if the insulating resistance of the entire solenoid is low, current flows across the adjacent turns of the coil windings to produce the same phenomenon as in short circuits.

In addition, in case where it is necessary to produce intermetallic compounds at a temperature higher than that required for $Nb_3Sn$, the glass fibers may melt at such high temperatures to produce short-circuits between the adjacent turns of the coil winding and thus can not provide any satisfactory electrical insulation.

SUMMARY OF THE INVENTION

In view of the above, the present invention is intended to obviate the above-mentioned problems of the prior art, and has for its object the provision of a superconducting solenoid in which workability, heat resistance and electrical insulation of the solenoid are improved to a practical extent.

In order to achieve the above object, according to the present invention, there is provided a superconducting solenoid comprising a winding frame, wires formed of filamentary conductors having superconductivity and wound around the winding frame, an insulator formed of alumina fiber material and covering each of the wires for providing electrical insulation, and a resinous material impregnated in between turns of the wires so as to provide a supporting structure.

In a preferred embodiment, a layer of glass fibers may be provided between each wire and the insulator.

Preferably, the insulator formed of alumina fiber material is in the form of a sheet or mat.

The above and other objects, features and advantages of the present invention will become apparent from the following detailed description of a few presently preferred embodiments of the invention when taken in conjunction with the accompanying drawings.

DESCRIPTION OF THE PREFERRED EMBODIMENTS

Figure 1:
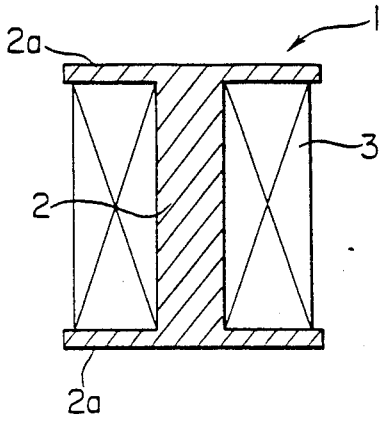
FIG. 1 is a side elevational view in cross section showing a superconducting solenoid in accordance with the present invention.

FIG. 1 shows a superconducting solenoid, generally designated by reference numeral 1, which is constructed in accordance with the principles of the present invention. In this Figure, the superconducting solenoid 1 comprises a winding frame or core 2 in the form of a cylinder having a pair of flanges 2*a* integrally formed at its opposite end, and coil winding 3 formed of wires 4 wound around the winding frame 2.

Figure 2A:
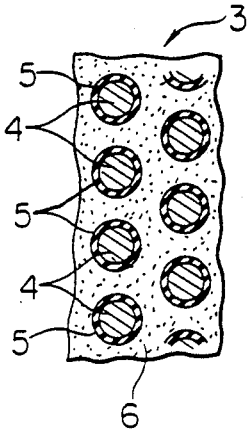
FIG. 2A is a cross section on an enlarged scale showing the details of a winding arrangement in accordance with the present invention.

Specifically, as illustrated in FIG. 2A, the wires 4 of the winding 3 are formed of filamentary conductors of $Nb_3Sn$, $V_3Ga$ or the like each of a circular cross section covered with an insulator 5 which is composed of alumina fiber material in the form of a sheet, a mat or the like. In this connection, it is to be noted that the alumina fiber material is particularly advantageous in that it can be readily formed into a sheet, not to mention the fact that alumina fiber material can, of course, be formed into a mat as well as a yarn. Such an advantage can not be obtained by glass fibers which, because of their intrinsic nature, are only used in the form of a yarn. Such a sheet-like formation of the alumina fiber material serves to materially improve workability in providing electrical insulation for the wires. Accordingly, the amount of binders such as starch to be added may be reduced considerably as compared with the case in which conventional glass fibers are employed. As a result, it is possible not only to simplify the construction of tools employed for winding the wires but also to shorten the time required for the winding operation. Moreover, reduction in insulating resistance of the solenoid 1 after winding can be effectively prevented to enhance reliability in operation.

The wires 4 each enclosed by the insulator 5 of alumina fiber material and wound around the winding frame 2 in the above-mentioned manner are fired in the conventional heat treatment process to produce superconducting compounds and then impregnated with a resinous material 6 to provide a superconducting solenoid 1 as a final product.

Figure 2B:
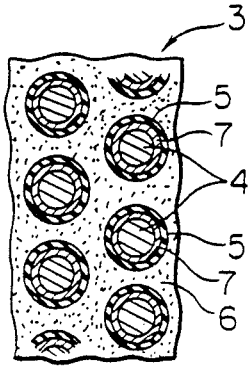
FIG. 2B is a cross section on an enlarged scale showing the details of an another winding arrangement in accordance with the present invention.
Figure 3:
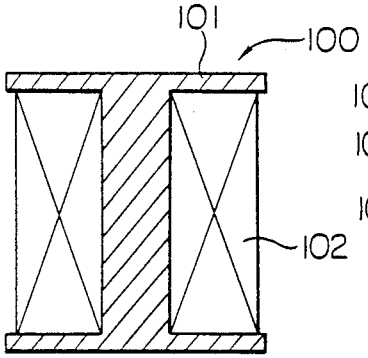
FIG. 3 PRIOR ART
FIG. 3 is a side elevational view in cross section showing a prior art superconducting solenoid.
Figure 4:
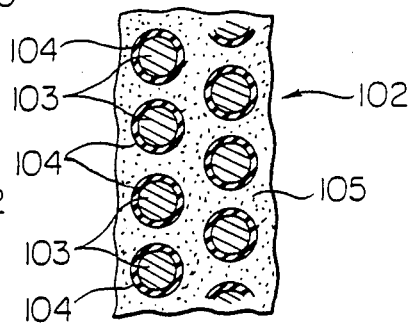
FIG. 4 PRIOR ART
FIG. 4 is a cross section on an enlarged scale showing the details of a winding arrangement of the prior art.

Although in the above-described embodiment, the wires 4 are each covered with the insulator 5 of alumina fiber material as shown in FIG. 2A, alumina fiber material can be used in combination with conventional glass fibers, as illustrated in FIG. 2B. In this case, each of the wires 4 of filamentary conductors is first enclosed by a layer 7 of the glass fibers and then covered with an insulator 5 of alumina fiber material. In this connection, it should be noted that the glass fibers 7 interposed between the wire 4 and the alumina fiber insulator 5 contain no binder so that a greater amount of the glass fibers 7, being less expensive than the alumina fiber material, can be used to reduce the production costs with substantially the same results as in the above-mentioned embodiment illustrated in FIG. 2A.

What is claimed is:

1. A superconducting solenoid comprising a winding frame, wires formed of filamentary conductors having superconductivity and wound around said winding frame, an insulator formed of alumina fiber material and covering each of said wires for providing electrical insulation, and a resinous material impregnated in between turns of said wires so as to provide a supporting structure.

2. A superconducting solenoid as claimed in claim 1 wherein said insulator formed of alumina fiber material is in the form of a sheet.

3. A superconducting solenoid as claimed in claim 1 wherein said insulator formed of alumina fiber material is in the form of a mat.

4. A superconducting solenoid as claimed in claim 1 further comprising an intermediate layer of glass fibers interposed between each of said wires and said insulator.

5. A superconducting solenoid as claimed in claim 4 wherein said insulator formed of alumina fiber material is in the form of a sheet.

6. A superconducting solenoid as claimed in claim 4 wherein said insulator formed of alumina fiber material is in the form of a mat.

* * * * *